United States Patent [19]

Rich et al.

[11] Patent Number: 4,974,393

[45] Date of Patent: Dec. 4, 1990

[54] APPARATUS AND METHOD FOR INSERTING OBJECTS INTO BALLOONS

[75] Inventors: Clayton E. Rich; Jesse D. Dye, both of Shelley; Kevin G. Heath; G. Bruce Stanger, both of Idaho Falls, all of Id.

[73] Assignee: Maxim Marketing, Inc., Salt Lake City, Utah

[21] Appl. No.: 326,612

[22] Filed: Mar. 21, 1989

[51] Int. Cl.[5] ..... B65B 31/00; B65B 31/02; B65B 43/36; B65B 67/02

[52] U.S. Cl. ..... 53/433; 53/403; 53/434; 53/441; 53/459; 53/468; 53/469; 53/486; 53/79; 53/86; 53/511; 53/512; 53/556; 53/386; 53/390; 141/8; 141/10; 141/65; 141/114

[58] Field of Search ..... 53/403, 432, 434, 441, 53/453, 459, 469, 479, 481, 86, 79, 512, 556, 559, 570, 385, 386, 390, 416, 433, 511; 141/51, 59, 10; 206/459

[56] References Cited

U.S. PATENT DOCUMENTS

| | | | |
|---|---|---|---|
| 1,283,095 | 10/1918 | Cummiskey . | |
| 1,745,576 | 2/1930 | Kempien . | |
| 2,158,837 | 5/1939 | Schukraft | 53/411 |
| 2,364,012 | 11/1944 | Walton et al. | 53/434 X |
| 2,383,390 | 8/1945 | Jacobs . | |
| 2,418,142 | 4/1947 | Socke | 53/386 |
| 2,463,517 | 3/1949 | Chromak . | |
| 2,531,795 | 11/1950 | Walter | 53/397 |
| 2,815,621 | 12/1957 | Carter | 141/51 X |
| 2,831,510 | 4/1958 | Carter | 53/386 X |
| 2,836,941 | 6/1958 | Hultkrans et al. | 53/411 |
| 3,321,103 | 5/1967 | Phillips | 53/390 X |
| 3,350,838 | 11/1967 | Rodrigues | 53/86 |
| 3,783,786 | 3/1957 | Carter | 141/59 X |
| 3,798,870 | 3/1974 | Kanner et al. | 53/386 X |
| 4,060,107 | 11/1977 | Naftulin | 141/10 X |
| 4,251,976 | 2/1981 | Zanni | 53/433 |
| 4,480,536 | 11/1984 | Burns | 53/585 X |
| 4,516,949 | 5/1985 | Schwartz | 53/403 X |
| 4,546,881 | 10/1985 | Tasma | 206/459 |
| 4,704,934 | 11/1987 | Nosrati . | |
| 4,753,060 | 6/1988 | Furukawa | 53/469 X |
| 4,809,483 | 3/1989 | Lovik | 53/385 X |
| 4,809,484 | 3/1989 | Lovik | 53/385 X |
| 4,811,841 | 3/1989 | Domenichiello . | |
| 4,878,335 | 11/1989 | Hardy | 53/385 X |
| 4,924,919 | 5/1990 | Oyler | 53/386 X |

FOREIGN PATENT DOCUMENTS

| | | |
|---|---|---|
| 893680 | 4/1962 | United Kingdom . |

*Primary Examiner*—Horace M. Culver

*Attorney, Agent, or Firm*—Thorpe, North & Western

[57] ABSTRACT

The present invention is directed to apparatus and methods for inserting objects into balloons. The apparatus preferably includes a housing having a balloon chamber and a vacuum pump chamber therein. The balloon chamber is large enough to accommodate an inflated balloon and has a lid through which the inflated balloon can pass. The vacuum pump chamber houses a vacuum pump which is in gaseous communication with the balloon chamber in order to create a vacuum therein. The lid includes an adjustable mechanism for first expanding and then maintaining a balloon orifice in an expanded condition to enable access to the interior of the balloon in a position in which the balloon extends downwardly from the lid to a position inside the balloon chamber. The vacuum pump may then be actuated to cause the balloon to inflate within the balloon chamber so that the desired object may be inserted through an access opening in the lid to the inside of the balloon. After the balloon is inflated and the object inserted thereinto, the access opening is capped so that the lid may be removed, dissipating the vacuum within the balloon chamber. The inflated balloon may then be tied and removed from the lid.

35 Claims, 5 Drawing Sheets

APPARATUS AND METHOD FOR INSERTING OBJECTS INTO BALLOONS

BACKGROUND

1. The Field of the Invention

The invention relates to apparatus and methods for inserting objects into balloons. More particularly, the apparatus of the present invention inflates a balloon by the application of external vacuum pressure and maintains the balloon in an inflated state while the user places an object into the inflated balloon.

2. Technology Review

Most people are struck with curiosity the first time they see a large object inside a fully inflated balloon. Typically, the person questions how such a large object could be placed inside the balloon without either ruining the balloon or the object. The person may also question how the object was placed inside an inflated balloon without letting all of the air out of the balloon. Thus, the ability to place objects into fully inflated balloons provides a unique and novel wrapping method for those objects.

An early device for inserting objects into balloons operated by inflating the balloons with positive pressure. The object to be inserted into the balloon was placed inside a box. The balloon orifice was stretched over a large cylindrical opening on the outside of the box. A compressor pressurized the inside of the box, causing the balloon to be inflated on the outside of the box. The user then placed the object into the inflated balloon using a flexible cuff attachment permitting the user to manipulate objects inside the box. The cuff attachment was essentially a rubber glove sleeve with the hand portion cut off.

This previous device, while capable of inserting objects into balloons, has several significant drawbacks. Chief among them is that a large compressor is needed to pressurize the box and inflate the balloon. Such a compressor is very heavy and not conveniently portable. Even a smaller, more easily transported compressor, does not have the capacity to rapidly and repeatedly pressurize the box and inflate the balloon.

Another significant problem is the difficulty in controlling air leakage. The entire apparatus must be built to withstand the substantial pressure required to inflate the balloon. The internal pressure exerted on the gaskets and sealant makes it difficult to retain air pressure within the box. It is particularly difficult to keep the cuff attachment from leaking air. Moreover, it is difficult to find a suitable cuff attachment for various arm sizes from small women's arms to large men's arms.

Yet another problem with this early device is that the object positioned within the inflated balloon tends to fall back into the box through the balloon orifice. To solve this problem, the user must reach through the cuff attachment and hold the object within the inflated balloon while simultaneously closing the balloon with the other hand on the outside of the box. This burdensome procedure exposes the user to the serious risk of the balloon bursting in the user's face while inserting the object into the balloon or during balloon inflation. Furthermore, it is often hard to extend the arm far enough into the box to insert the object into the inflated balloon.

Based upon the foregoing concept of placing objects into fully inflated balloons, it was found that a balloon could be placed inside a box and readily inflated using a vacuum rather than using positive air pressure. As a result, the interior of the balloon would be at atmospheric pressure. The object could then be placed into the inflated balloon without the need for a specially designed cuff attachment.

Despite its advantages, initial designs utilizing this technique possess some disadvantages. For example, the vacuum is separate from the box and is attached to the box via a vacuum hose. In addition, the box contains a manual valve which must be operated at various stages of the process of inserting objects into a balloon.

Finally, the box does not accommodate differently sized balloons. The box lid, which holds the balloon, is only designed to hold a single balloon size. In order to place objects into differently sized balloons, the entire box lid must be replaced with one designed to accommodate the desired size. Because the box lids were relatively large and bulky, it was very inconvenient to use differently sized balloons. Furthermore, the entire lid of the box must be removed to install the balloon and to withdraw the balloon after insertion.

Another problem common to both the positive pressure and vacuum pressure devices is the difficulty of stretching balloon orifices wide enough to accommodate large objects. This necessary stretching of the balloon orifice is nearly impossible for many people. In addition, the extensive stretching of the balloon orifice frequently results in tearing or other destruction of the balloon. Repeated balloon tearing by the user can become very costly.

From the foregoing, it will be appreciated that what is needed in the art are apparatus for inserting objects into balloons which are vacuum operated so that the disadvantages of a pressurized system are avoided.

It would be another advancement in the art to provide apparatus for inseting objects into balloons which are self contained and easily portable units thereby avoiding the inconvenience of a separate vacuum attached to the device by a hose.

Additionally, it would be a significant advancement in the art to provide apparatus for inserting objects into balloons which do not require the entire box lid to be changed in order to use differently sized balloons.

It would be another advancement in the art to provide apparatus for inserting objects into balloons which do not require a manually operated valve.

It would be yet another important advancement in the art to provide apparatus for inserting objects into balloons which facilitates stretching balloon orifices by most users thereby substantially reducing the risk of balloon damage and waste and improving efficiency.

Such apparatus for inserting objects into balloons are disclosed and claimed herein.

BRIEF SUMMARY AND OBJECTS OF THE INVENTION

The present invention is directed to apparatus and methods for inserting objects into balloons. The apparatus preferably is a self contained unit. In one embodiment, the apparatus includes a housing which has both a balloon chamber and a vacuum pump chamber therein. The balloon chamber is large enough to accommodate an inflated balloon and has an opening through which the inflated balloon can pass. The vacuum pump chamber houses a vacuum which is connected to the balloon chamber through a valve. The valve permits air to be removed from the balloon chamber to form a vacuum therein, but prevents air from entering the balloon chamber to destroy the vacuum.

A lid covers the opening of the balloon chamber. The lid may be hinged to the housing to permit access to the interior of the balloon chamber. Gasket material between the lid and the balloon chamber opening permits the lid to form an airtight seal with the balloon chamber. In one embodiment within the scope of the present invention, the lid has an opening in the center thereof for accommodating a replaceable hub. The apparatus may include a door for accessing the interior of the balloon chamber, instead of a hinged lid. Alternatively, the apparatus may include both a hinged lid and a door for the user's convenience.

The replaceable hub preferably has a balloon retaining cylinder with a circumference which holds a balloon orifice in a stretched or expanded condition. The balloon retaining cylinder is adapted to be positioned within the balloon chamber. It is currently preferred that each replaceable hub will have a differently sized balloon retaining cylinder so that each hub will be designed to hold a differently sized balloon.

A discontinuous groove is preferably located about the circumferential periphery of the cylinder. The groove helps hold the balloon orifice on the balloon retaining cylinder. The discontinuity in the groove allows the balloon orifice to be readily removed from within the groove.

A cylindrical collar having a size approximately equal to that of the balloon retaining cylinder may be positioned about the periphery of the retaining cylinder to securely hold a stretched balloon orifice around the retaining cylinder during operation. The cylindrical collar preferably includes some biasing means to permit the collar to be expanded when placed around the retaining cylinder and to provide a biasing force to constrict the collar. The cylindrical collar is particularly useful when a large object is to be inserted within the balloon which might otherwise cause the balloon orifice to slip from the balloon retaining cylinder.

The replaceable hub also includes a balloon access cylinder for accessing the interior of the inflated balloon through the enlarged balloon orifice. It is presently preferred that the balloon access cylinder for each replaceable hub be approximately equal in size. Objects to be inserted inside the balloon must pass through both the balloon access cylinder and the balloon retaining cylinder before entering the inflated balloon.

In another embodiment within the scope of the present invention, the lid includes a plurality of longitudinally slidable fingers which slide within a corresponding plurality of slots. The slots extend radially from the center of the lid. Each finger has a hook at one end thereof for gripping the balloon orifice and a roller at the other end thereof. The hook ends of the fingers are located substantially in the center of the lid with the remainder of the fingers extending radially therefrom. The roller ends of the fingers track roller channels formed in a guide template which controls the longitudinal movement of the fingers.

When the hooks are positioned close together in the center of the lid, a balloon orifice may be readily placed around the hooks. By sliding the fingers longitudinally away from the center of the lid, the balloon orifice is stretched into an expanded condition. To accomplish this, the guide template, in combination with the finger rollers provide a means for adjusting and controlling the longitudinal movement of the fingers, thereby permitting differently sized balloons to be used.

The apparatus within the scope of the present invention preferably includes a foot operated electrical switch for controlling the operation of the vacuum. A foot switch frees the users hands to manipulate the object during insertion within the balloon. In addition, the foot switch allows the user to apply vacuum "on demand" during insertion.

The apparatus within the scope of the present invention also includes a balloon applicator to facilitate stretching or applying a balloon orifice around the balloon retaining cylinder. It will be appreciated that in order to place large objects inside a balloon, the balloon orifice must be enlarged substantially. This necessary stretching of the balloon orifice is nearly impossible for many people. In addition, the very act of stretching the balloon orifice often results in tearing or other destruction of the balloon. Repeated balloon tearing by the user can become very costly. Therefore, the balloon applicator was developed to facilitate stretching a balloon orifice around the balloon retaining cylinder.

The balloon applicator preferably is in a semicylindrical shape having a size slightly larger than the balloon retaining cylinder. A groove is located about the periphery of the balloon applicator to hold the balloon orifice to the applicator. In practice, a balloon orifice is stretched around the semicylindrical balloon applicator. That portion of the balloon orifice which is not in contact with the applicator is then positioned around the balloon retaining cylinder. The entire applicator is drawn past the retaining cylinder and rotated so that the balloon orifice slips off the applicator and onto the retaining cylinder.

In use, a balloon orifice is positioned around the retaining cylinder and held in place with a cylindrical collar. The hub is then placed on the apparatus lid such that the retaining cylinder and the balloon are within the balloon chamber. Thereafter, the foot switch is actuated causing the balloon to inflate due to vacuum pressure within the balloon chamber. Once the balloon is inflated, the desired object may be inserted within the balloon. The balloon access cylinder is then capped to seal the balloon interior. Thereafter, the hinged lid is opened, dissipating the vacuum within the balloon chamber. Finally, the balloon is removed from the retaining cylinder and tied.

It is, therefore, an object of the present invention to provide apparatus and methods for inserting objects into balloons which are vacuum operated so that the disadvantages of a pressurized system are avoided.

An additional object of the present invention is to provide apparatus for inserting objects into balloons which are self contained and easily portable units thereby avoiding the inconvenience of a separate vacuum attached to the device by a hose.

Another important object of the present invention is to provide apparatus for inserting objects into balloons which use a single lid that accommodates small replaceable hubs designed for differently sized balloons so that the entire box lid does not need to be changed in order to use differently sized balloons.

A further important object of the present invention is to provide apparatus for inserting objects into balloons which have a single lid which may be adjusted to hold differently sized balloons, thereby eliminating the need for replaceable hubs.

An additional important object of the present invention is to provide apparatus for inserting objects into balloons which use a one-way valve thereby avoiding the inconvenience of using a manually operated value.

Yet another important object of the present invention is to provide apparatus for inserting objects into balloons which facilitates stretching balloon orifices by most users thereby substantially reducing the risk of balloon damage and waste and improving efficiency.

Still another object of the present invention is to provide apparatus for inserting objects into balloons which may be foot-operated thereby freeing the users hands and enhancing operating convenience.

These and other objects and features of the present invention will become more fully apparent from the following description and appended claims, taken in conjunction with the accompanying drawings, or may be learned from the practice of the invention.

BRIEF DESCRIPTION OF THE DRAWINGS

FIG. 1A is an enlarged, perspective view of a portion of collar 42 of FIG. 1.

DETAILED DESCRIPTION OF THE PREFERRED EMBODIMENTS

In order to more fully understand the manner in which the above-recited advantages and objects of the invention are obtained, a more particular description of the invention will be rendered by reference to specific embodiments thereof which are illustrated in the appended drawings. It is understood that these drawings depict only one or more typical embodiments of the invention and are therefore not to be considered limiting of its scope. The presently preferred embodiments and the presently understood best mode of the invention will be described with additional detail through reference to the accompanying drawings wherein like parts are designated with like numerals throughout.

Figure 1:
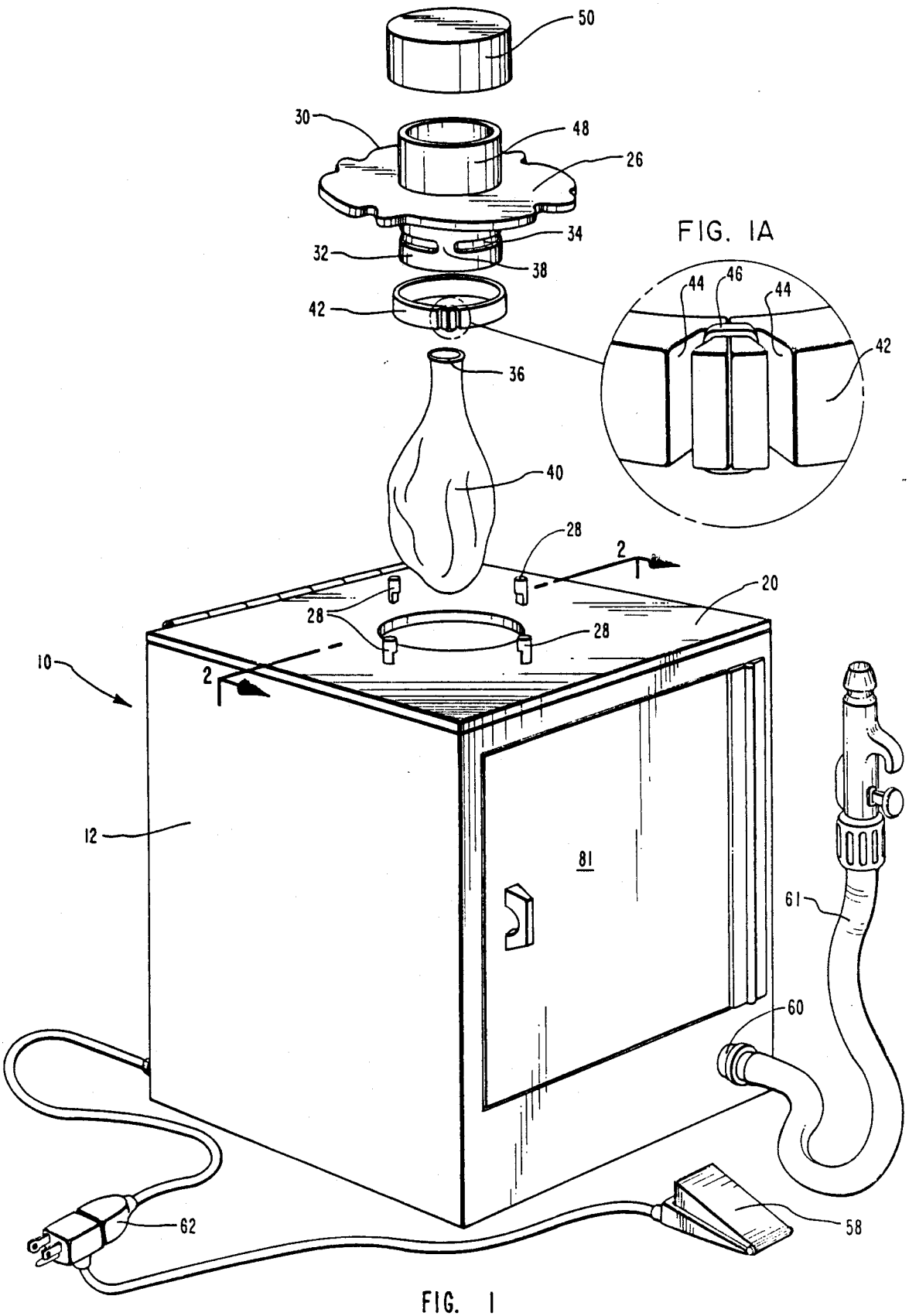
FIG. 1 is a perspective view of one embodiment within the scope of the present invention.
Figure 2:
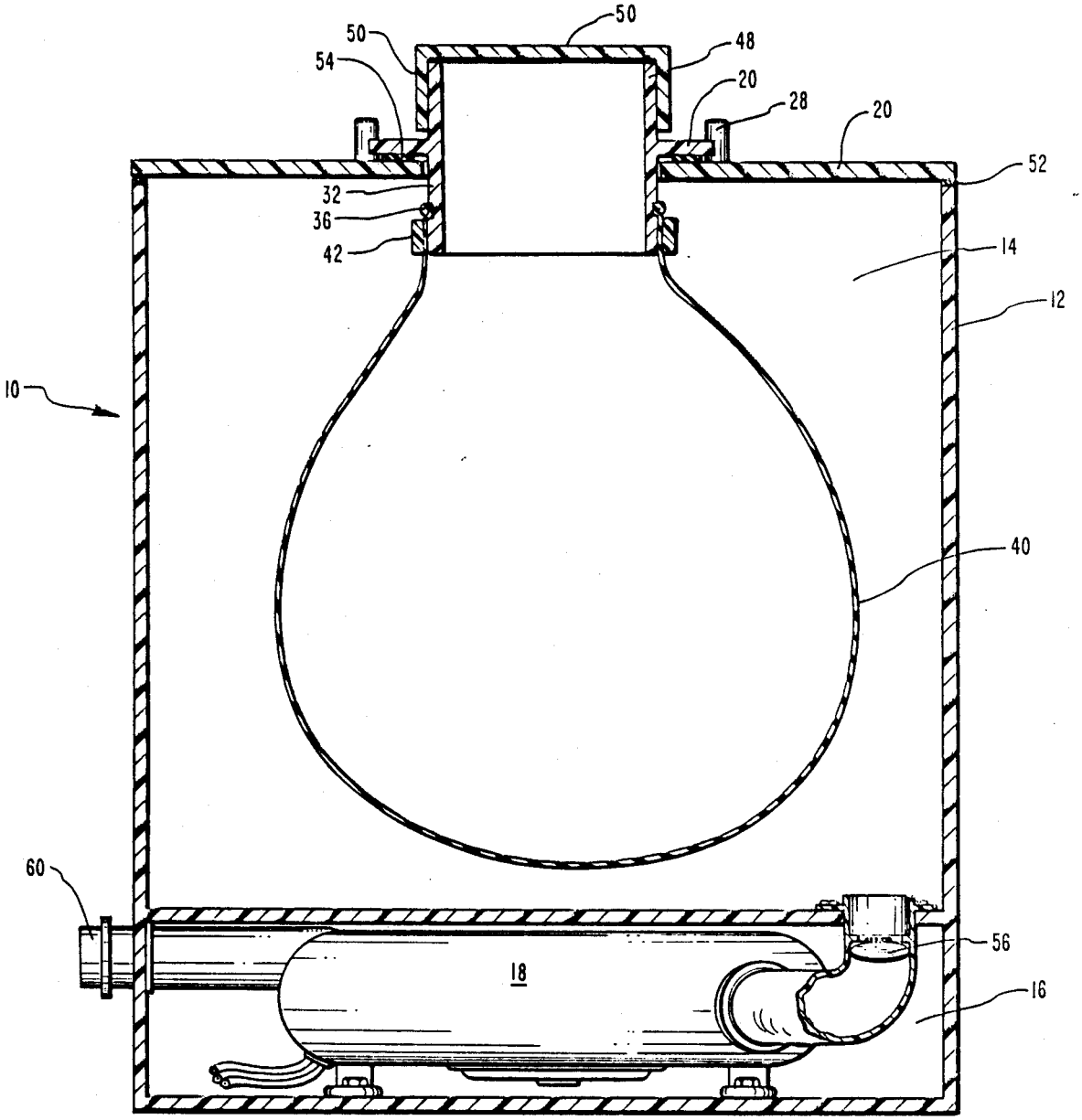
FIG. 2 is a cross-sectional view of the embodiment of the present invention taken along line 2—2 of FIG. 1.

Referring first to FIGS. 1 and 2, an apparatus for inserting objects into balloons is illustrated and generally designated 10. Apparatus 10 includes housing 12 which defines balloon chamber 14 and vacuum pump chamber 16 therein. A vacuum 18 is located within the vacuum pump chamber which is in gaseous communication with balloon chamber 14.

Lid 20 covers the top of housing 12. As shown in FIG. 1, lid 20 is hinged to housing 12, thereby allowing lid 20 to be opened to permit removal of an inflated balloon located within balloon chamber 14. Lid 20 defines an opening 24 in the center of lid 20. The apparatus may also be equipped with door 81 to permit easy access to the interior of balloon chamber 14. Door 81 is preferably large enough to permit removal of an inflated balloon from within balloon chamber 14.

In the embodiment illustrated in FIGS. 1 and 2, lid 20 and opening 24 are adapted to receive replaceable hub 26. A plurality of notched pins 28 are located on lid 20 around opening 24. The notched pins facilitate proper placement of hub 26 on lid 20. The shape of hub 26 shown in FIG. 1 is for convenience in interfacing with pins 28. Hub 26 includes camming surface 30 which exerts a camming force against notched pins 28 when hub 26 is rotated. It will be appreciated that other geometric configurations for hub 26 could be devised which would cooperate with pins 28 to facilitate placement of hub 26 and to secure hub 26 to lid 20.

Lid 20 is configured to include means for maintaining the opening of a balloon in an expanded condition as well as providing access to the interior of an inflated balloon. In the embodiment shown in FIGS. 1 and 2, hub 26 includes balloon retaining cylinder 32.

Balloon retaining cylinder 32 preferably has a circumference sufficiently large to accommodate a balloon orifice in an expanded condition. A discontinuous groove 34 is preferably located about the circumferential periphery of the balloon retaining cylinder 32. Groove 34 helps hold balloon orifice 36 on balloon retaining cylinder 32. Groove discontinuity 38 allows balloon orifice 36 to be readily removed from within groove 34.

As shown in FIGS. 1 and 2, balloon retaining cylinder 32 is adapted to be positioned within balloon chamber 14. Thus, balloon 40 is positioned and inflated within balloon chamber 14. It is currently preferred that each replaceable hub 26 will have a differently sized balloon retaining cylinder 32 so that each hub will be designed to hold a differently sized balloon.

A cylindrical collar 42 having an inside diameter approximately equal to the outside diameter of the balloon retaining cylinder may be positioned about the periphery of balloon retaining cylinder 32 to securely hold a stretched balloon orifice 36 around the retaining cylinder during operation. Cylindrical collar 42 preferably includes some biasing means to permit the collar to be expanded when placed around balloon retaining cylinder 32 and to provide a biasing force to constrict the collar. The cylindrical collar is particularly useful when large objects are being inserted within balloon 40 which might otherwise cause balloon orifice 36 to slip from balloon retaining cylinder 32.

FIG. 1A illustrates, in an enlarged view, one potential means for biasing cylindrical collar 42. A rubber band 46 is positioned within two converging notches 44 cut into collar 42. In this way, the collar may be expanded for placement around the balloon retaining cylinder and also provide a biasing force to hold balloon orifice 36 during operation.

Replaceable hub 26 also includes balloon access cylinder 48 for accessing the interior of the inflated balloon through the expanded balloon orifice. Objects to be inserted inside the balloon must pass through both the balloon access cylinder and the balloon retaining cylinder before entering the inflated balloon.

Cap 50 is designed to enclose balloon access cylinder 48 and form a substantially airtight seal therewith. Cap 50 is preferably constructed out of a material capable of forming an airtight seal with the balloon access cylinder. It has been found that cap 50 may be suitably constructed of soft rubber. It is currently preferred that the balloon access cylinder for each replaceable hub be approximately equal in size so that a single cap 50 can be used with all hubs.

Because the present invention inflates the balloon using vacuum pressure, it is important that balloon chamber 14 be substantially airtight. Therefore, gasket material 52 and 54 is advantageously used to seal lid 20 to housing 12 and hub 26 to lid 20, respectively.

A valve 56 provides gaseous communication between vacuum 18 and balloon chamber 14. It is presently preferred that valve 56 permit air to be removed from the balloon chamber to form a vacuum therein, but prevent air from entering the balloon chamber to destroy the vacuum. Hence, valve 56 is preferably a one-way valve.

Another important feature within the scope of the present invention is a foot operated electrical switch 58 for controlling the operation of the vacuum. Foot switch 58 frees the user's hands to manipulate the object during insertion within the balloon. In addition, foot switch 58 allows the user to apply vacuum "on demand" during insertion. Of course, it will be appreciated that well known hand operated electrical switches will function adequately. Nevertheless, it has been found that foot switch 58 significantly enhances the efficiency of the process for inserting objects into balloons. Although foot switch 58 illustrated in FIG. 1 is positioned between electrical plug 62 and an electrical wall outlet (not shown), it will be appreciated that one skilled in the art could design a foot switch coupled directly to the vacuum pump which performs the same function.

Yet another important feature within the scope of the present invention is a vacuum exhaust port 60 into which an adapter 61 may be inserted for inflating balloons with positive air pressure. Hence, one user may inflate balloons into which objects had been previously inserted using adapter 61 while a second user inserts objects into balloons according to the techniques described herein. Adapter 61 coupled to vacuum exhaust port 60 is particularly useful in cases where high demand for "stuffed balloons" exists. For example, at athletic events where school mascots or sweat shirts might be inserted within balloons, twice the number of finished balloons may be produced in a given time period by having one operator insert objects into balloons and another operator inflate previously inserted balloons.

It will be appreciated that the apparatus within the scope of the present invention may be operated with standard current and voltage sources, as illustrated by electrical plug 62. This feature further enhances the portability of the apparatus.

Figure 3:
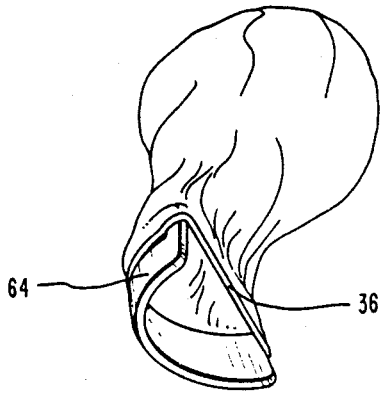
FIG. 3 is a perspective view of a balloon stretched about a balloon applicator within the scope of the present invention.
Figure 4:
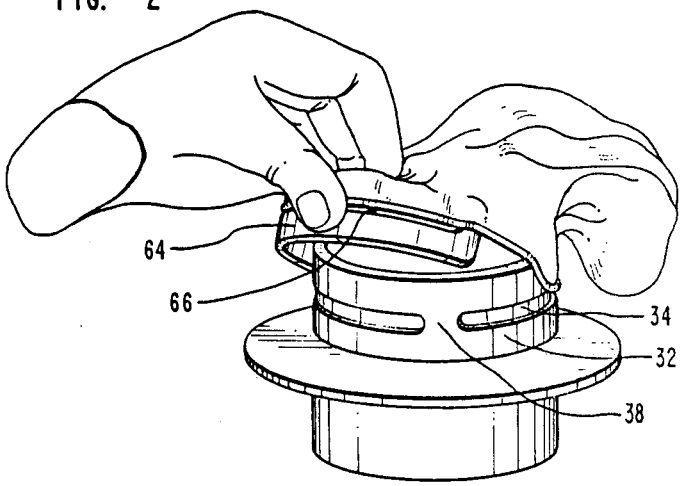
FIG. 4 is a perspective view of the balloon applicator shown in FIG. 3 transferring the balloon to a balloon retaining cylinder within the scope of the present invention.

Reference is now made to FIGS. 3 and 4. The apparatus within the scope of the present invention also includes a balloon applicator 64 to facilitate stretching or applying balloon orifice 36 around balloon retaining cylinder 32. It will be appreciated that in order to place large objects inside a balloon, the balloon orifice must be expanded substantially. In the past, this necessary stretching of the balloon orifice often results in tearing or other destruction of the balloon. Repeated balloon tearing by the user becomes very costly. In addition, many users cannot physically install balloons around balloon retaining cylinder 32. Therefore, balloon applicator 64 was developed to facilitate stretching a balloon orifice around the balloon retaining cylinder.

Balloon applicator 64 preferably is in a semicylindrical shape having an inside radius slightly larger than the outside radius of balloon retaining cylinder 32. A groove 66 is located about the periphery of the balloon applicator to hold the balloon orifice to applicator 64. In practice, balloon orifice 36 is stretched around semicylindrical balloon applicator 64. That portion of the balloon orifice which is not in contact with the balloon applicator is then positioned around balloon retaining cylinder 32. The entire applicator is drawn past the retaining cylinder 32 and rotated so that balloon orifice 36 slips off balloon applicator 64 and onto retaining cylinder 32.

In use, a properly sized balloon 40 is selected and balloon orifice 36 is positioned around retaining cylinder 32 of hub 26. Cylindrical collar 42 is placed around retaining cylinder 32 to securely hold balloon orifice in an expanded condition. Hub 26 is then positioned on lid 20 such that retaining cylinder 32 and balloon 40 are within balloon chamber 14. Thereafter, foot switch 58 is actuated causing balloon 40 to inflate due to vacuum pressure within balloon chamber 14. Once the balloon is inflated, the desired object may be inserted within the balloon through balloon access cylinder 48. The balloon interior is then sealed by capping the balloon access cylinder with cap 50. Thereafter, lid 20 or door 81 is opened, dissipating the vacuum within balloon chamber 14. Finally, the balloon is removed from the retaining cylinder and tied. It will be appreciated that "typing" the balloon, as that term is used herein, includes a traditional tied knot as well as a tied string, a clamp, or some other means for closing the balloon orifice of an inflated balloon.

Reference is now made to FIGS. 5–9 illustrating another embodiment within the scope of the present invention. Lid 70 may include an adjustable means for maintaining balloon orifice 36 in an expanded condition. One such apparatus includes a plurality of longitudinally slidable fingers 72 which slide within a corresponding plurality of slots 74. Slots 74 extend radially from the center of lid 70. Each finger has a hook 76 at one end thereof for gripping the balloon orifice and a roller 78 at the other end thereof. Hook ends 76 of fingers 72 are located substantially in the center of the lid with the remainder of the fingers extending radially therefrom. Roller ends 78 of fingers 72 track roller channels 79 formed within template template 80 which controls the longitudinal movement of the fingers.

When hooks 76 are positioned close together in the center of the lid, a balloon orifice may be readily placed around the hooks. By sliding the fingers longitudinally away from the center of the lid, the balloon orifice is stretched into an expanded condition. To accomplish this, roller channels 79 of guide template 80, in combination with finger rollers 78, provide a means for adjusting and controlling the longitudinal movement of the fingers, thereby permitting differently sized balloons to be used.

In another embodiment within the scope of the present invention, guide template 80 may be configured so as to cover and protect the internal operating mechanism for the adjustable lid.

Figure 5:
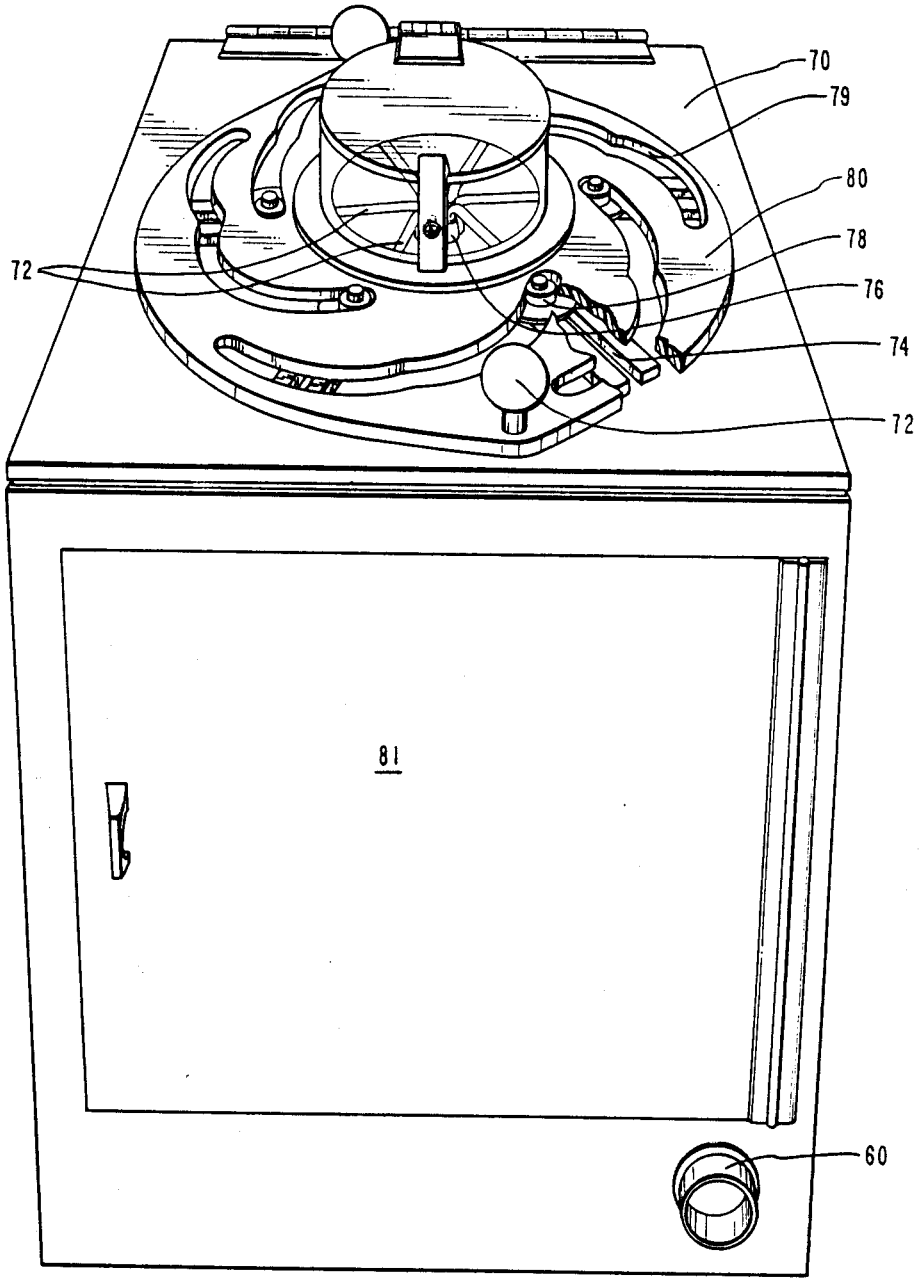
FIG. 5 is a perspective view of another embodiment within the scope of the present invention having a balloon chamber lid which may be adjusted to accommodate differently sized balloons with a single device.
Figure 6:
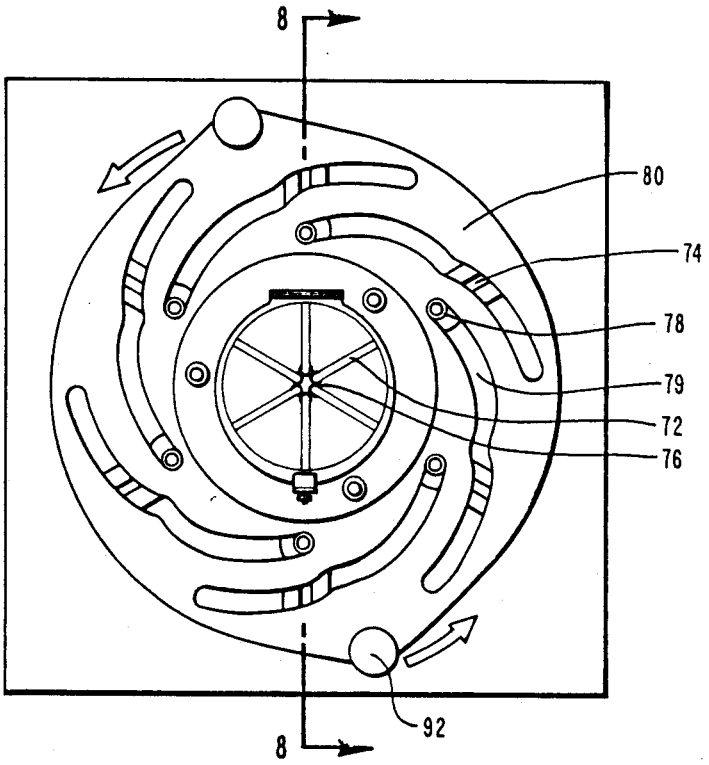
FIG. 6 is a top view of the balloon chamber lid illustrated in FIG. 5 showing the plurality of fingers close together.
Figure 7:
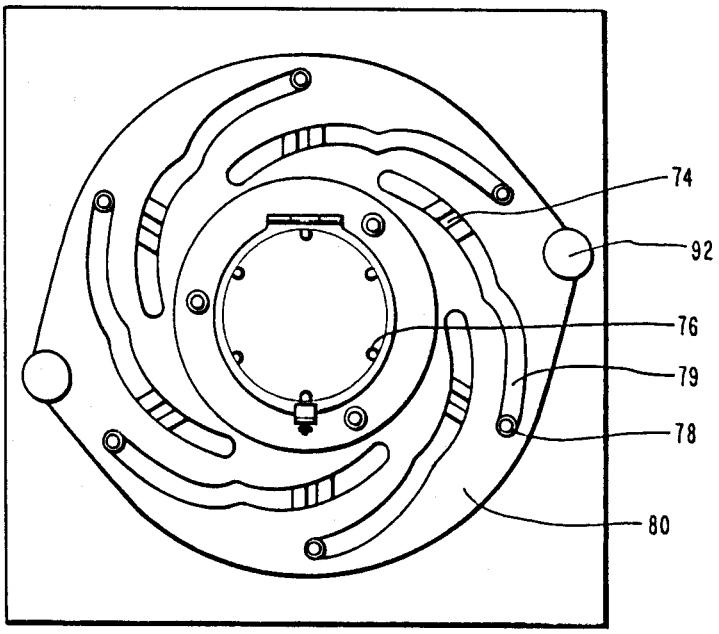
FIG. 7 is a top view of the balloon chamber lid illustrated in FIG. 6, except that the plurality of fingers are separated.
Figure 8:
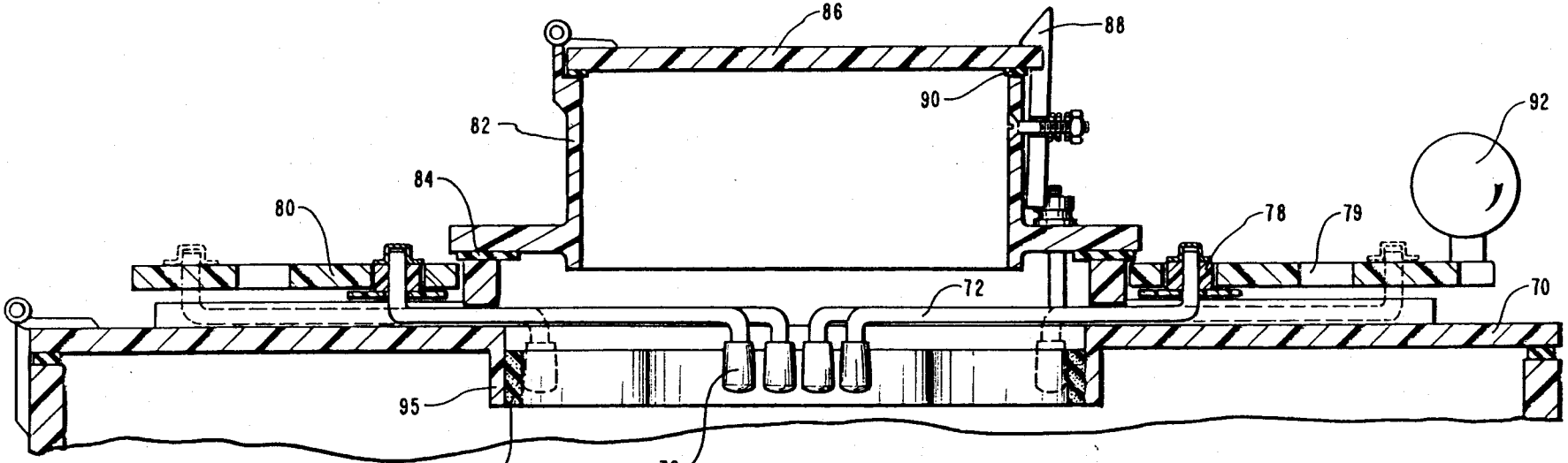
FIG. 8 is a cross-sectional view of the embodiment illustrated in FIG. 6 taken along line 8—8 of FIG. 6.
Figure 9:
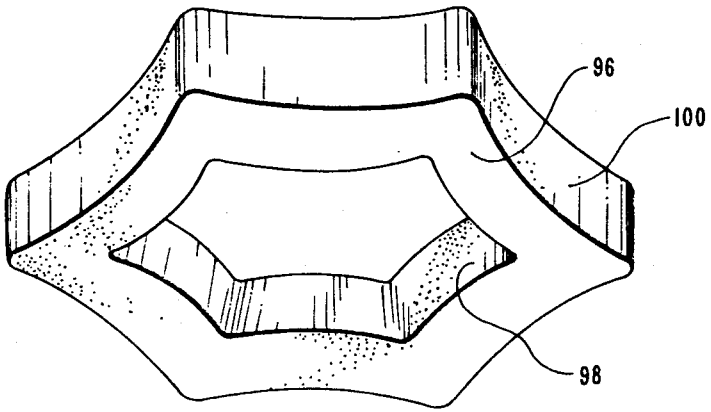
FIG. 9 is a perspective view of an insert adapted to be used with the balloon chamber lid illustrated in FIG. 5 in order to permit the use of differently sized balloons.

Door 81, shown in FIG. 5, permits easy access to the interior of balloon chamber 14. Door 81 preferably includes gasket material around the edge thereof for forming a substantially airtight seal with the balloon chamber. Door 81 also reduces wear and tear on lid 70 caused by repeated opening and closing. In fact, the need for a hinged lid is eliminated in those embodiments within the scope of the present invention having door 81, although both may be present to improve operation convenience. As a result, the lid can be permanently mounted on housing 12 which will provide improved airtight sealing between the housing and the lid.

A balloon access cylinder 82 for accessing the interior of an inflated balloon is preferably secured to lid 70. Gasket material 84 is located between balloon access cylinder 82 and lid 70 for providing a substantially airtight seal therewith. A cap 86 may be hinged to access cylinder 82 for enclosing balloon access cylinder 82. Spring biased latch 88 securely holds cap 86 tight against balloon access cylinder 82. Gasket material 90 is preferably located between cap 86 and balloon access cylinder 82 for providing a substantially airtight seal therewith.

In use, lid 70 is opened or door 81 is opened, depending on the apparatus and the user's convenience. Balloon orifice 36 is then positioned around hooks 74. This may be readily accomplished with minimal stretching of the balloon orifice. Lid 70 or door 81 is closed so that the balloon is within the balloon chamber. Handles 92, secured to guide template 80, are rotated such that roller channels 79 cause longitudinal movement of rollers 78 in a radial direction. As a result, hooks 74 enlarge the balloon orifice and hold the balloon orifice securely against gasket material 94 which lines opening 95 in lid 70.

Thereafter, foot switch 58 is actuated causing balloon 40 to inflate due to vacuum pressure within balloon chamber 14. Once the balloon is inflated, the desired object may be inserted within the balloon through balloon access cylinder 82. The balloon interior is then sealed by capping the balloon access cylinder with cap 86. Thereafter, lid 70 or door 81 is opened, dissipating the vacuum within balloon chamber 14. Finally, the inflated balloon is removed from hooks 74 by rotating handles in the opposite direction thereby causing fingers 72 to slide longitudinally toward the center of lid 70.

Should the user desire to use differently sized balloons, insert 96 may be placed within opening 95. Insert 96 has an inner surface 98 and an outer surface 100. Insert 96 reduces the effective size of opening 95. As a result, the maximum allowable expansion of hooks 74 is limited. In this way, balloon orifices may be safely expanded to a smaller diameter. Insert 96 is preferably constructed of a soft material which will fit snugly within opening 95 and yet form a substantially airtight seal with the opening and with a balloon orifice pressed against inner surface 98.

It will be appreciated that the function of the embodiment illustrated in FIGS. 5–9 may be achieved by other embodiments which are not illustrated herein. For example, another device for expanding balloon orifices may be suitably used. It is not critical that longitudinally slidable fingers be used. Moreover, the precise number of fingers used in the embodiment illustrated in FIGS. 5–9 may be modified so long as the same function is performed.

From the foregoing it will be appreciated that the present invention provides apparatus and methods for inserting objects into balloons which are vacuum operated thereby avoiding the disadvantages of a pressurized system. In addition, the apparatus within the scope of the present invention are self contained and easily portable units. As a result, many of the inconveniences of a system using a bulky separate vacuum pump are avoided. Likewise, the present invention provides apparatus for inserting objects into balloons which use a one-way valve thereby avoiding the inconvenience of using a manually operated value.

Additionally, the present invention provides apparatus for inserting objects into balloons which use a single lid that accommodates small replaceable hubs designed for differently sized balloons so that the entire box lid does not need to be changed in order to use differently sized balloons. Alternatively, the present invention provides apparatus for inserting objects into balloons which use a single lid that may be adjusted to hold differently sized balloons, thereby eliminating the need for replaceable hubs.

The present invention further provides apparatus for inserting objects into balloons which facilitates stretching balloon orifices by most users thereby substantially reducing the risk of balloon damage and waste and improving efficiency. Additionally, the present invention provides apparatus for inserting objects into balloons which may be foot-operated thereby freeing the user's hands and enhancing operating convenience.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for inserting an object into a balloon comprising:

a housing defining a balloon chamber and a vacuum pump chamber therein, said balloon chamber having a size sufficient to accommodate an inflated balloon and having an opening sufficiently large to pass an inflated balloon therethrough, and said vacuum pump chamber accommodating a vacuum pump therein;

a valve in gaseous communication with the balloon chamber and with the vacuum pump within the vacuum pump chamber, said valve permitting air to be removed from the balloon chamber to form a vacuum within the balloon chamber and said valve preventing air to enter the balloon chamber thereby maintaining the vacuum within the balloon chamber;

a lid for covering the opening of the balloon chamber and having means for forming a substantially airtight seal with the balloon chamber, and means for accommodating a replaceable hub, a replaceable hub for removable disposition in the accommodating means and having means for maintaining the orifice of the balloon in a predetermined expanded condition, means for accessing the interior of the inflated balloon through the expanded balloon orifice, and means for forming a substantially airtight seal with the lid; and a removable cap for forming a substantially airtight seal with the accessing means.

2. An apparatus for inserting an object into a balloon as defined in claim 1, further comprising an adapter in gaseous communication with the vacuum pump such that exhaust gas from the vacuum pump flows through said adapter to permit inflation of balloon through positive air pressure.

3. An apparatus for inserting an object into a balloon as defined in claim 1, wherein the means for maintaining the balloon orifice in an expanded condition comprises a balloon retaining cylinder having an outside diameter sufficiently large to accommodate the balloon orifice in an expanded condition, said balloon retaining cylinder having a discontinuous groove located about the circumferential periphery of the cylinder.

4. An apparatus for inserting an object into a balloon as defined in claim 1, wherein the means for accessing the balloon orifice comprises a hollow balloon access cylinder.

5. An apparatus for inserting an object into a balloon as defined in claim 3, further comprising a cylindrical collar having an inside diameter approximately equal to the outside diameter of the balloon retaining cylinder and being biased such that the collar securely holds a balloon orifice stretched about the periphery of the balloon retaining cylinder during operation of the apparatus.

6. An apparatus for inserting an object into a balloon as defined in claim 1, further comprising a foot-operated electrical switch for controlling the operation of the vacuum pump.

7. An apparatus for inserting an object into a balloon as defined in claim 3, further comprising means for securing the balloon orifice about the periphery of the balloon retaining cylinder.

8. An apparatus for inserting an object into a balloon as defined in claim 7, wherein the means for securing the balloon orifice about the periphery of the balloon retaining cylinder comprises a semicylindrical balloon applicator having an inside radius slightly larger than the outside radius of the balloon retaining cylinder, said balloon applicator having a groove located about the periphery of the balloon applicator to hold the balloon orifice to the applicator.

9. An apparatus for inserting an object into a balloon as defined in claim 1, wherein the lid is hinged to the opening of the balloon chamber.

10. An apparatus for inserting an object into a balloon as defined in claim 1, further comprising a door for accessing the interior of the balloon chamber and for allowing passage of an inflated balloon therethrough, said door having means for forming a substantially airtight seal with the balloon chamber.

11. An apparatus for inserting an object into a balloon comprising:

a balloon chamber having a size sufficient to accommodate an inflated balloon, said balloon chamber having an opening sufficiently large to pass an inflated balloon therethrough;

a vacuum pump in communication with the balloon chamber for pumping air from the balloon chamber to form a vacuum therein;

cover means disposable over the opening of the balloon chamber for forming a substantially airtight seal with the balloon chamber, and for receiving an expanded orifice of a balloon so that the balloon extends into the balloon chamber, said cover means also having means for accessing the balloon orifice;

balloon orifice expanding means insertable into an unexpanded balloon orifice and operable to expand the orifice for receipt by the cover means; and a removable cap for forming a substantially airtight seal with the means for accessing the balloon orifice.

12. An apparatus for inserting an object into a balloon as defined in claim 11, further comprising an adapter in gaseous communication with the vacuum pump such that exhaust gas from the vacuum pump flows through said adapter to permit inflation of a balloon through positive air pressure.

13. An apparatus for inserting an object into a balloon as defined in claim 11, wherein the balloon orifice expanding means is adjustable to accommodate different sized balloons.

14. An apparatus for inserting an object into a balloon as defined in claim 11, wherein the means for accessing the balloon orifice comprises a balloon access cylinder.

15. An apparatus for inserting an object into a balloon as defined in claim 11, further comprising a foot-operated electrical switch for controlling the operation of the vacuum.

16. An apparatus for inserting an object into a balloon as defined in claim 11, wherein the balloon chamber and the vacuum pump chamber are housed within a single housing.

17. An apparatus for inserting an object into a balloon as defined in claim 11, wherein the cover means is hinged to the opening of the balloon chamber.

18. An apparatus for inserting an object into a balloon as defined in claim 11, further comprising a door for accessing the interior of the balloon chamber and for allowing passage of an inflated balloon therethrough, said door having means for forming a substantially airtight seal with the balloon chamber.

19. An apparatus for inserting an object into a balloon comprising a balloon chamber having a size sufficient to accommodate an inflated balloon, said balloon chamber having an opening sufficiently large to pass an inflated balloon therethrough;

a vacuum pump in communication with the balloon chamber for pumping air from the balloon chamber to form a vacuum therein;

a lid disposable over the opening of the balloon chamber for forming a substantially airtight seal with the balloon chamber, said lid having means for accessing the balloon orifice, and means for expanding and maintaining a balloon orifice in an expanded condition including a plurality of gripping elements disposed to move between a first position in which the elements are bunched together generally near the center of the lid for receiving a balloon orifice, and a second position in which the elements are spaced apart to expand the balloon orifice, and means for selectively causing said gripping elements to move between said first and second positions.

20. An apparatus for inserting an object into a balloon as defined in claim 19 further including movement control means for selectively controlling the distance from the first position to the second position through which the gripping elements are moved.

21. An apparatus for inserting an object into a balloon as defined in claim 19 wherein said balloon orifice expanding and maintaining means further comprises an opening formed in said lid to define an access to the balloon interior, said gripper elements being positioned generally in the center of the opening when in the first position and against the perimeter of the opening when in the second position.

22. An apparatus for inserting an object into a balloon as defined in claim 21 wherein said balloon orifice expanding and maintaining means further comprises a replaceable insert means for placement in the lid opening for reducing the size of the access to the interior of the balloon.

23. An apparatus for inserting an object into a balloon as defined in claim 22 wherein said insert means comprises an annulus having an outer surface for placement in sealing contact with the perimeter of the lid opening, and an inner surface formed in the shape of a polygon whose sides between points of the polygon are convex, and wherein each of said gripping elements is disposed to move to a respective point of the annulus inner surface when the gripping elements are moved to the second position.

24. An apparatus for inserting an object into a balloon as defined in claim 19 wherein said gripping elements each comprises a finger having a hook at one end for gripping a balloon orifice, and wherein said causing means comprises means for moving the fingers so that the hooks move from a bunched position, in which a balloon orifice may be placed about the hooks, to a spaced-apart position, in which the hooks expand the balloon orifice.

25. An apparatus for inserting an object into a balloon as defined in claim 24 wherein the fingers each further has a roller at the other end thereof, and wherein the hooks of said fingers are located substantially in the center of the lid with the remainder of said fingers extending radially therefrom, said fingers being longitudinally moveable such that when the hooks are positioned close together in the center of the lid, a balloon orifice may be placed around the hooks and when the fingers are moved longitudinally away from the center of the lid, the balloon orifice is maintained in an expanded condition.

26. An apparatus for inserting an object into a balloon as defined in claim 25, further comprising means for adjusting the longitudinal movement of the plurality of fingers thereby permitting the balloon orifice to be enlarged to different diameters to accommodate insertion of differently sized objects into the balloon.

27. An apparatus for inserting an object into a balloon as defined in claim 26, wherein the means for adjusting the longitudinal movement of the plurality of fingers comprises a guide template having a plurality of roller channels for accommodating each finger roller therein, said guide template configured such that rotation of the guide template causes the finger rollers to move within the roller channels thereby longitudinally sliding the fingers.

28. A method for inserting an object into a balloon comprising the steps of:

(a) selecting a balloon of sufficient size to accommodate an object therein when fully inflated, said balloon having a balloon orifice;

(b) selecting a replaceable hub having a balloon retaining cylinder thereon with a circumference sufficiently large to accommodate a balloon opening in an expanded condition, said balloon retaining cylinder having a discontinuous groove located about the circumferential periphery of the cylinder;

(c) stretching the balloon orifice around the balloon retaining cylinder;

(d) positioning the balloon retaining cylinder of the replaceable hub within a balloon chamber such that the balloon is within the balloon chamber and such that the interior of the balloon is accessible from outside the balloon chamber;

(e) evacuating the air within the balloon chamber such that the balloon is inflated;

(f) inserting an object into the inflated balloon;

(g) removing the inflated balloon from the balloon retaining cylinder; and (h) tying the inflated balloon.

29. A method for inserting an object into a balloon comprising the steps of:

(a) selecting a balloon of sufficient size to accommodate an object therein when fully inflated, said balloon having a balloon orifice;

(b) placing the balloon orifice around a plurality of hooks such that the balloon is positioned within a balloon chamber, each hook being formed at one end of a moveable finger, said fingers extending outwardly from said hooks;

(c) moving the plurality of fingers outwardly such that the hooks stretch and maintain the balloon orifice in an expanded condition and such that the interior of the balloon is accessible from outside the balloon chamber;

(d) evacuating the air within the balloon chamber such that the balloon is inflated;

(e) inserting an object into the inflated balloon;

(f) removing the inflated balloon from the balloon chamber; and (g) tying the inflated balloon.

30. An apparatus for inserting an object into a balloon comprising:

a housing defining a balloon chamber and a vacuum pump chamber therein, said balloon chamber having a size sufficient to accommodate an inflated balloon and having an opening sufficiently large to pass an inflated balloon therethrough, and said vacuum pump chamber accommodating a vacuum pump therein;

a valve in gaseous communication with the balloon chamber and with the vacuum pump within the vacuum pump chamber, said valve being a one-way valve such that air can be evacuated from the balloon chamber through the valve to reduce the pressure therein, but air cannot enter the balloon chamber through the valve;

a lid covering the opening of the balloon chamber having means for forming a substantially airtight seal with the balloon chamber, said lid also having means for accommodating a replaceable hub, said replaceable hub having a balloon retaining cylinder adapted to be positioned within the balloon chamber and having a circumference sufficiently large to accommodate a balloon orifice in an expanded condition, said balloon retaining cylinder having a discontinuous groove located about the circumferential periphery of the cylinder, said hub also having a balloon access cylinder for accessing the interior of the inflated balloon through the enlarged balloon orifice, and said hub having means for forming a substantially airtight seal with the lid;

a removable cap for forming a substantially airtight seal with the balloon access cylinder; and a foot-operated electrical switch for controlling the operation of the vacuum.

31. An apparatus for inserting an object into a balloon as defined in claim 30, further comprising a cylindrical collar having an inside diameter approximately equal to the outside diameter of the balloon retaining cylinder and being biased such that the collar securely holds a balloon orifice stretched about the periphery of the balloon retaining cylinder during operation of the apparatus.

32. An apparatus for inserting an object into a balloon as defined in claim 31, wherein the means for readily applying the balloon orifice about the periphery of the balloon retaining cylinder comprises a semicylindrical balloon applicator having an inside radius slightly larger than the outside radius of the balloon retaining cylinder, said balloon applicator having a groove located about the periphery of the balloon applicator to hold the balloon orifice to the applicator.

33. An apparatus for inserting an object into a balloon as defined in claim 30, further comprising means for readily applying the balloon orifice about the periphery of the balloon retaining cylinder.

34. An apparatus for inserting an object into a balloon as defined in claim 30, wherein the lid is hinged to the opening of the balloon chamber.

35. An apparatus for inserting an object into a balloon as defined in claim 30, further comprising a door for accessing the interior of the balloon chamber and for allowing passage of an inflated balloon therethrough, said door having means for forming a substantially airtight seal with the balloon chamber.

* * * * *